United States Patent [19]

Martens et al.

[11] Patent Number: 4,561,254

[45] Date of Patent: Dec. 31, 1985

[54] INITIAL STEAM FLOW REGULATOR FOR STEAM TURBINE START-UP

[75] Inventors: Alan Martens, Berwyn; Milton M. Hobbs, Marple Township, Delaware County; Gerald A. Myers, Swarthmore, all of Pa.

[73] Assignee: Westinghouse Electric Corp., Pittsburgh, Pa.

[21] Appl. No.: 664,641

[22] Filed: Oct. 25, 1984

[51] Int. Cl.[4] ..... F01K 13/02

[52] U.S. Cl. ..... 60/660; 60/656; 290/40 C

[58] Field of Search ..... 60/646, 656, 660, 667; 290/40 C

[56] References Cited

U.S. PATENT DOCUMENTS

| | | | |
|---|---|---|---|
| 3,172,266 | 3/1965 | Strohmeyer, Jr. | 60/656 |
| 3,226,932 | 1/1966 | Strohmeyer, Jr. | 60/656 |
| 3,939,328 | 2/1976 | Davis | 60/660 X |
| 3,948,043 | 4/1976 | Martz | 290/40 R X |
| 3,959,973 | 6/1976 | Meylan | 60/656 X |
| 3,973,391 | 8/1976 | Reed et al. | 60/39.29 |
| 3,974,643 | 8/1976 | Smith et al. | 60/39.18 B |
| 4,031,404 | 6/1977 | Martz et al. | 290/40 R |
| 4,091,450 | 5/1978 | Bloch et al. | 60/660 X |
| 4,201,924 | 5/1980 | Uram | 290/40 R |
| 4,220,869 | 9/1980 | Uram | 290/40 R |
| 4,222,229 | 9/1980 | Uram | 60/39.03 |
| 4,258,424 | 3/1981 | Giras et al. | 364/494 |
| 4,267,458 | 5/1981 | Uram et al. | 290/40 R |
| 4,333,310 | 6/1982 | Uram | 60/39.18 B |

*Primary Examiner*—Stephen F. Husar

*Attorney, Agent, or Firm*—C. M. Lorin

[57] ABSTRACT

In a combined steam generator-turbine system, a drain type is provided in front of the stop valve to drain the first steam supply with the stop valve closed until the temperature of the valve and/or the temperature of the steam exceeds the temperature of saturation by a predetermined amount, and logic circuitry is provided to generate permissive signals which combine to allow successive admission of steam to the gland seal and to the steam turbine.

4 Claims, 6 Drawing Figures

INITIAL STEAM FLOW REGULATOR FOR STEAM TURBINE START-UP

BACKGROUND OF THE INVENTION

The present invention relates to method and apparatus for controlling the admission of steam to a steam turbine especially for cold start-up thereof, or steam turbine restart.

When steam turbines are stopped for short periods of times, the rotor body casing and shaft hold a temperature close to operational temperature, whereas the piping and fluid lines which have been closed or are remote will cool off rapidly. Therefore, at restart, there is a large temperature difference between the freshly admitted steam and the pipes and/or valves exposed to it. Also for cold start-up, the steam at high temperature and pressure enters the various organs leading to the turbine which are at a much lower temperature. These gradients of temperature cause thermal stresses which can be damaging to the equipment, in particular, the valves, the gland seal zone and the rotor and casing of the turbine. Since most often the boiler provides superheated steam, when the latter reaches the cold walls of the pipes and valves, it cools off and takes the form of wet steam. Condensation of water in the pipes, the valves and the gland seal region of the turbine is a cause of erosion which will damage the walls, seals and turbine blades.

The invention provides for a method of and apparatus for controlling the admission of steam to a steam turbine so as to prevent large differences in temperature along the critical passageways from the steam generator to the turbine, when the turbine is to be started, or restarted.

It is acknowledged as prior art in U.S. Pat. No. 4,091,450 (H. Bloch) to control steam throughput or steam temperature in order to limit thermal stresses on the organs of a turbine. This patent proposes for an optimal start-up to coordinate the start-up of the turbine and generator units by increasing simultaneously and steadily the load absorption of the turbine and the inlet temperature.

It is known from U.S. Pat. No. 3,959,973 (P. Meylan) to protect the shaft-stuffing boxes of a steam turbine from water condensation of the admitted steam by deriving the steam initially to the condenser until it has become dry and superheated.

SUMMARY OF THE INVENTION

The invention resides in providing for the derivation of steam from the front of a main stop valve in its closed state through an auxiliary drain pipe and valve leading to the condenser of the associated steam turbine during start-up thereof, such steam derivation being maintained until the body temperature of the main valve exceeds the temperature of saturation, at which time the auxiliary drain valve is closed and full steam is allowed to pass through the open main valve.

The invention is applicable to any throttle valve for the admission of steam to a steam turbine in relation to a chest valve, or to any stop valve (butterfly or clapper type) of a steam admission system.

Control logic is provided operative in relation to specific stages of the steam pressure and temperature build-up in sequential order and selectively through the duct lines in preparation of turbine latching and loading. Preheating of the stop valve according to the invention reduces warm-up time for piping and valves. This is achieved by an increased flow of warm steam provided through the derivation line and monitored for controlled warm-up.

Gland seal steam is not applied to the steam turbine until such time as the available steam matches the gland body temperature, thereby avoiding thermal stresses in the gland region and extending the life of the turbine as a whole.

The invention also allows an increased initial flow of steam from the boiler without any additional dumping in the atmosphere, as would be the case prior to establishment of a vacuum in the condenser. In addition, the admission of steam and flow from the boiler are introduced in a gradual rather than a sudden manner likely to cause jolting and to provoke boiler drum swell when the initial flow is established through the turbine bypass valve.

BRIEF DESCRIPTION OF THE DRAWINGS

FIG. 5 shows the valve relay circuit of FIG. 5 inserted in the logic circuitry of FIG. 3 and interposed between the steam generator-steam turbine control system and the drain valve according to the present invention.

DESCRIPTION OF THE PREFERRED EMBODIMENTS

Figure 1:
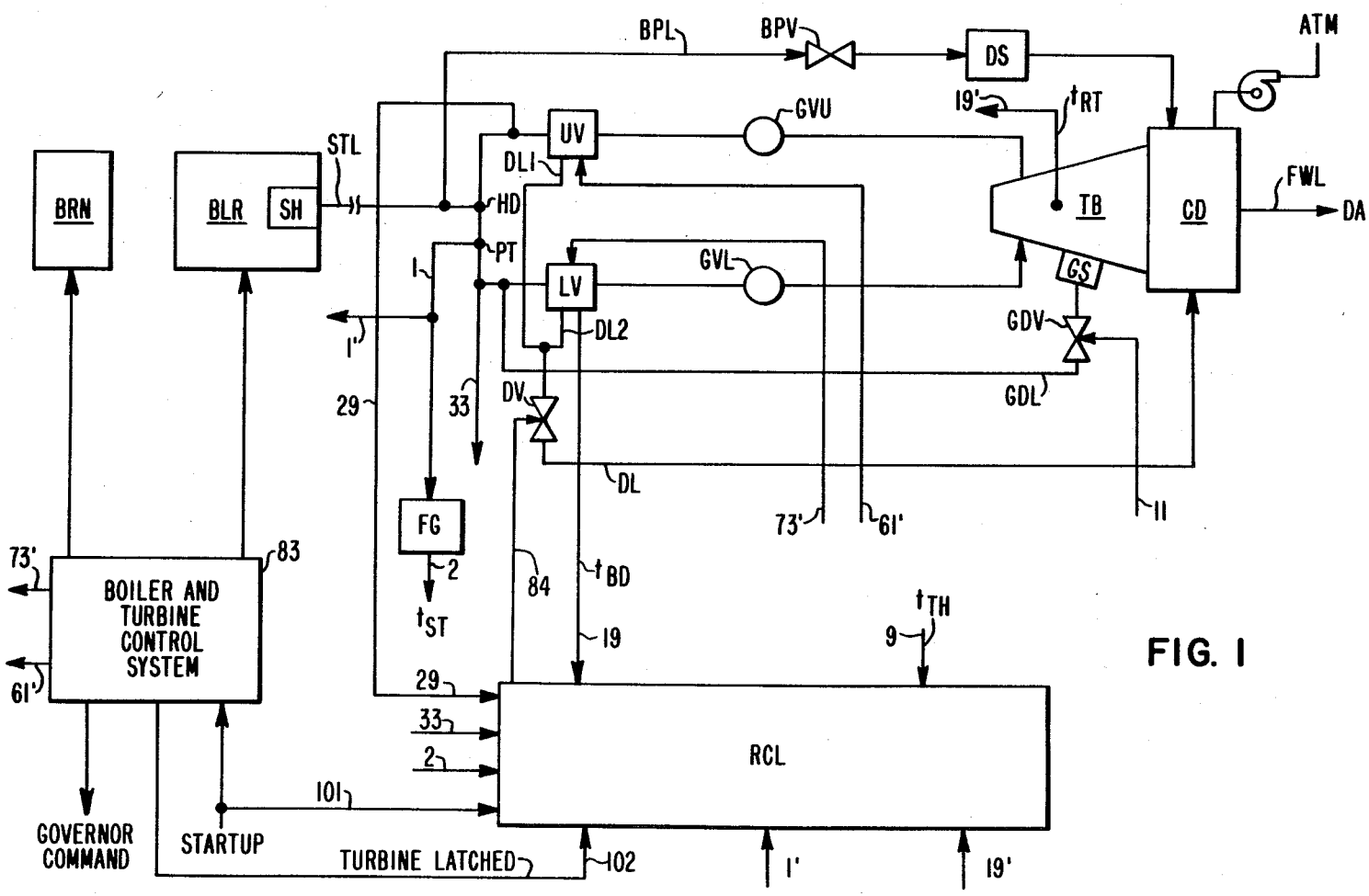
FIG. 1 is a block diagram of a steam generator-steam turbine installation including the initial steam flow regulator for turbine start-up according to the invention.
Figure 2:
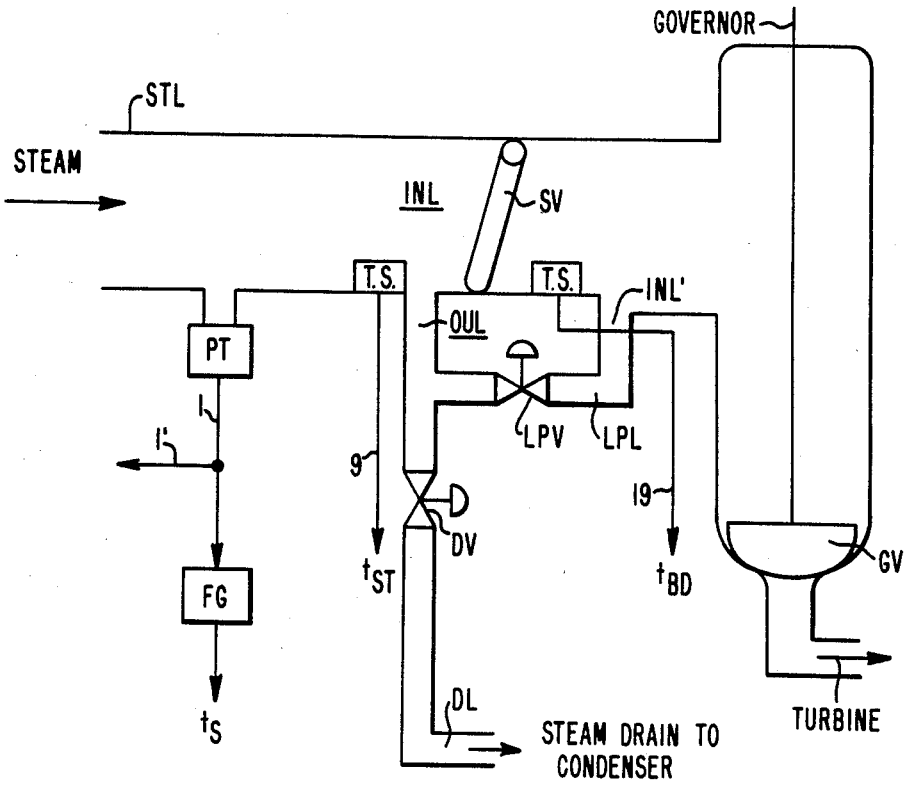
FIG. 2 illustrates with more details the drain valve and drain line associated with one stop valve of the turbine steam admission in the system of the diagram of FIG. 1.

Referring to FIG. 1, a block diagram shows in simplified form a steam turbine system embodying the present invention. A superheater SH belonging to a heat recovery steam generator, or boiler, BLR provides steam in a steam line STL from a remote location to a turbine TB having a condenser CD associated thereto. The steam is supplied to the turbine through upper and lower stop valves, or throttle valves UV, LV, and upper and lower governor valves GVU, GVL. When the turbine is to be started after the condenser has been set to vacuum, a bypass line BPL allows to derive steam, through a bypass valve BPV and via a desuperheater DS, to the condenser CD, until full operation of the turbine at which time all the steam is allowed to pass fully through the throttle valves. At start-up (line 101) when the steam is initially reaching the inlet INL of the throttle valves UV, LV, referring to FIG. 2 illustrating either UV or LV at the inlet INL, while the valve is still closed, provision is made in front of the stop valve member SV for a passageway LPL bypassing the stop valve from an outlet OUL near the inlet INL onto a back inlet INL. Passageway LPL includes a valve LPV. It is used for the elimination of any condensation of water from steam against the walls of the valve, or the piping, when it is still cold.

According to the present invention, from the outlet OUL, a drain line DL is formed leading, via an auxiliary drain valve DV, to the condenser. Drain valve DV is open by deenergizing a relay at start-up under control by line 101 (FIG. 1). Thus, when the main stop valve SV is still closed, and auxiliary drain valve DV is open, under the pressure of generated steam expanded down to the condenser, the incoming steam is evacuated carrying heat through the piping, along the front walls of the main stop valve SV and down the drain line DL. If the steam is initially unfit for turbine operation (because it is too cold or wet), such poor quality steam is thereby eliminated while providing heat nearby under drain flow. Progressively, in the superheater SH, steam is building up at the proper pressure and temperature. The steam pressure in line STL is sensed at the entry of the stop valves (UV and LV in FIG. 1) by a pressure transducer PT and a signal is derived on lines 1 and 1'. The signal of line 1 is fed to a function generator FG which converts any sensed pressure into a signal representing a corresponding temperature of saturation $t_{ST}$ on line 2. The function generator FG is programmed in accordance with the known characteristic table of saturated steam at any given temperature. Accordingly, function generator FG converts the pressure indicative signal and provides on line 2 a signal representing the temperature of saturation. At the front end of the main valve SV (FIG. 2), e.g., near the steam inlet INL, or the steam outlet OUL of the drain pipe DL, a temperature sensor TS provides an indication of the steam temperature $t_{TH}$ in the neighborhood of main stop valve SV, the representative signal being carried on line 9. The temperature ($t_{BD}$) of the body of valve SV is also sensed and derived on line 19. The signals of lines 1', 2, 9 and 19 (FIG. 1) are inputted into a relay control logic RCL. The temperature of the rotor body $t_{RT}$ is derived by line 19' and inputted into circuit RCL. The relay control logic RCL, as explained hereinafter by reference to FIG. 3, outputs command signals on line 11 to the controller relative to the gland seal valve GDV of the turbine, and on line 84 to the controller relative to the drain valve DV. It is understood that when opening of the gland seal valve GDV, according to the present invention, occurs and when closing of the drain valve DV, according to the present invention, occurs, these two steps become part of a general start-up sequencing procedure under the control system 83 of the heat recovery steam generator and steam turbine such as shown in FIG. 1. Thus, opening of the gland seal valve GDV to establish a seal on the turbine is a step preceding establishing a vacuum in the condenser of the turbine before admission of steam therein. Also, after the drain valve DV has been closed, steam is allowed to enter the steam turbine by upper stop valve UV and lower stop valve LV, namely with a flow of steam larger than 100 KPPH. On the other hand, after closing of the drain valve, the boiler pump valve is controlled and bypass control takes place until acceleration of the turbine up to speed with governor valve control when there is enough steam in the header, typically at least 300 KPPH flow. Signals generated automatically or applied by the operator are interpreted by the control system 83 of the boiler and turbine installation, whereby control signals are applied to the turbine as required by the aforestated sequencing procedure during start-up.

Figure 3:
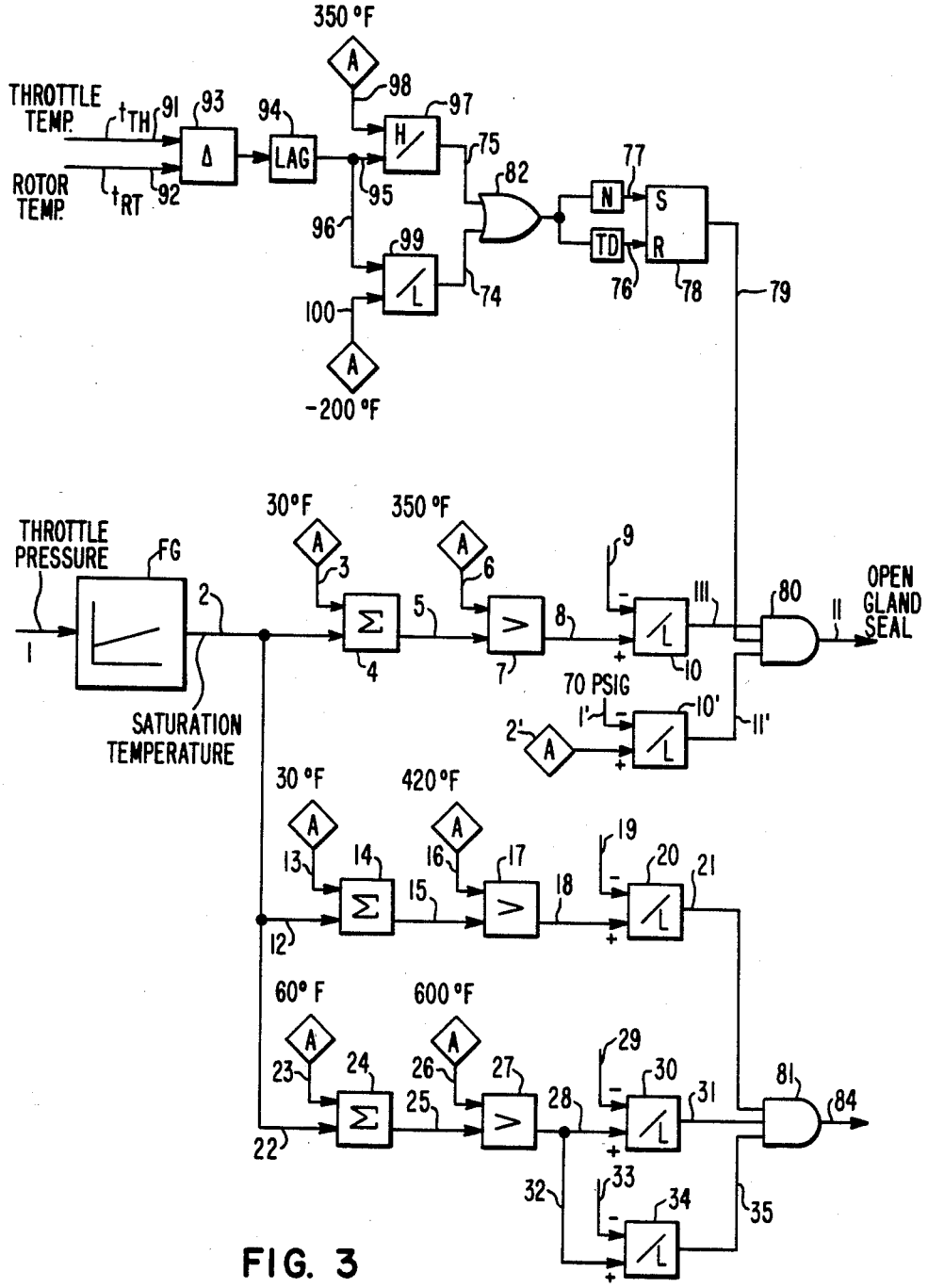
FIG. 3 shows logic circuitry as can be used with the regulator of FIG. 1 to monitor critical steam levels and control the glad seal valve and drain valves in the turbine system.

Initially, when the turbine is cold and the condenser has no vacuum, the stop valves LV, UV and bypass valve BPV are closed. At this time, the steam coming from the superheater SH into the boiler BLR (FIG. 1) is not yet fully superheated, and the piping of the steam line STL to the stop valves UV, LV is cold. Primary heating occurs which results in condensation of water. At this early stage, water and steam are evacuated by the action of valve LPV through evacuation conduit LPL. Then, as superheated steam is building up, valve LPV is closed and, according to the present invention, heat flow through the drain pipe DL is effected by opening drain valve DV, allowing the pressure of steam to expand steam down to the condenser. Also, in accordance with the present invention, the steam drainage through pipe DL is maintained until two orders of conditions are satisfied:

The first order of conditions is typified on FIG. 3 by the logic of AND device 80 and output signal 11 conditioning control to open the gland seal valve. One condition is that there is a sufficient pressure build-up to insure a good seal by the gland seal of the turbine schematized by block GS in FIG. 1. A typical value to satisfy such condition is as shown by input line 11' to AND device 80 that the steam has reached 70 psig. Such value is ascertained from lines 1' (from pressure transducer PT) and 2' (setpoint value) and interpreted by comparator 10' of the logic cicruit RCL, so as to generate a logic signal on line 11' permitting opening of the gland valve GDV.

A second condition (tested by line 79 to AND device 80) to be satisfied before opening the gland seal valve, as explained hereinafter, is that the rotor temperature and the throttle temperature have become close enough to prevent thermal stresses (lines 74 and 75, OR device 82 and line 79 into AND device 80).

A third condition (line 1, function generator FG, lines 8 and 9 and line 111 into AND device 80) is that the throttle temperature has reached at least 350° or that it exceeds the saturation temperature plus 30° F.

When those three conditions have been satisfied, steam is admitted by line GDL into the gland seal GS of the turbine (FIG. 1) from the header HD by gland line GDL through the gland seal valve. GDV is allowed to be open.

When the seal is effective, procedure is taken by the control system 83 for evacuating air from the condenser and create a vacuum. However, the system is not yet going to normal operation, e.g., either from bypass line BPL via the bypass valve BPV (if it is opened) and the desuperheater DS, or from the main steam supply STL after the stop valves UV, LV have been permitted to open steam admission to the turbine and flow control by the governor valves GVU, GVL. Before this a second order of conditions are required, which determine closing of the steam drainage through DL. One of these conditions is that the temperature of the valve and piping has reached a value which exceeds the temperature of saturation of the steam by a predetermined amount, typically 30° F. This is ascertained as illustrated in FIG. 3 by sensing the throttle pressure (line 1), converting the signal so derived into saturation temperature (function generator FG and lines 2 and 12) adding a 30° F. setpoint (line 13) to the saturation temperature signal (line 12). The resulting signal is on line 15. The same is done with a setpoint of 60° F. (line 23), rather than 30° F. to derive (line 22 and summer 24) a temperature signal on line 25. As detected by comparator 17 (FIG. 3) when the signal of line 15 reaches 420° F., a signal is obtained on line 18 to which the valve body temperature $t_{BD}$ (line 19) is compared by comparator 20. When the signal of line 25 reaches 600° F., a signal is obtained on line 28 to which is compared by comparator 30 the temperature of the lower drain line piping (line 29), and a signal is obtained on line 32 to which is compared by comparator 24 the temperature of the upper drain line piping (line 33).

The three conditions of comparators 20, 30 and 34 outputted by respective lines 21, 31 and 35 are gathered by an AND device 81. When all inputs to AND device 81 are high, the output thereof on line 84 is high. Therefore, the logic signal of line 84 tells the control system to close the drain valve DV. When this, as interpreted by the logic control circuit RCL, has happened the control system is enabled to cause the lower valve LV and the upper valve UV to open, and control of the steam turbine admission valves by lines 61' and 73' can follow as generally known. Steam can safely pass through the throttle valves, the governor valves and the turbine blades, casing and rotor body in a dry and superheated state. As a result of the preparatory step allowed by line 11 for the gland seal and the step allowed by line 84 for the drain valve DV, the control circuit RCL has enabled to provide an early indication allowing steam admission, acceleration of the turbine, soaking period, and loading of the turbine, which operations are conducted by the control system 83 following latching of the turbine.

Figure 4:
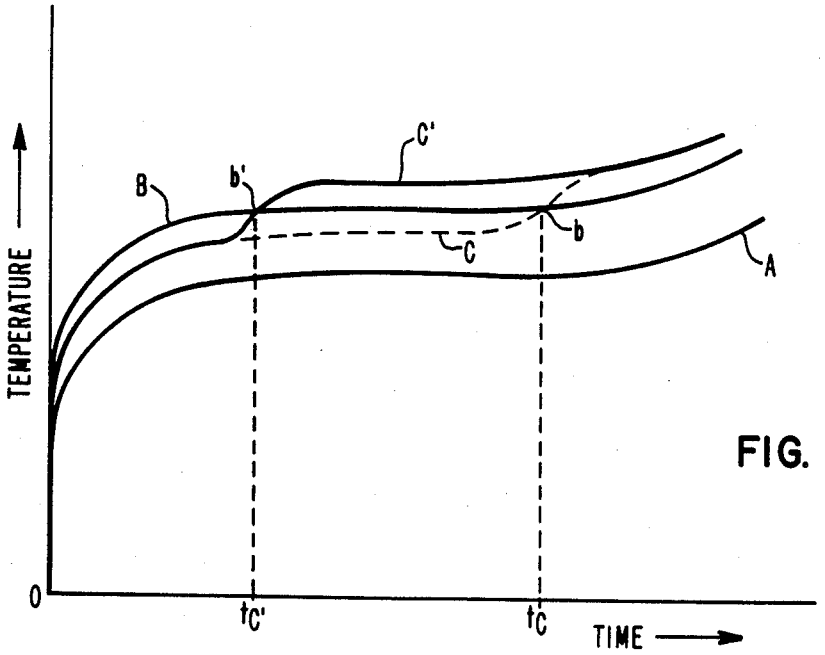
FIG. 4 shows temperature curves as a function of time illustrating by comparison the advantage of using the present invention.

Referring to FIG. 4, curve (A) represents the temperature of saturation of steam as a function of time while it gains energy, e.g., pressure and temperature, in the superheating process during the start-up period with the boiler. Curve (B) represents the temperature of saturation plus 30° F. Thus, curve (A) is as derived on lines 2, 12 and 22 of FIG. 3, while curve (B) is as derived on lines 5 and 15 of FIG. 3. In dotted line is represented by curve (C) the temperature of the steam turbine (rotor body, valve, or piping) gaining temperature while the steam is being admitted. At time $t_C$ curve (C) will exceed the pressure of saturation of steam, which means that dry or superheated steam is now in contact with the walls of the piping, the exposed surfaces of the valves, the blades and the rotor and casing of the turbine. Therefore, until time $t_C$ there is wet steam which by condensation can in the long run cause all the aforementioned damages along the line of supply of steam to the turbine from the boiler.

The drain pipe in accordance with the invention draws steam from the supply line STL from the boiler thereby causing a rapid heat flow in front of the sensitive inlet to the valves and turbine system. As a result, the boiler may be activated so as to increase the build-up of steam at operative pressure and temperature without damaging the system. Thus, at an earlier time $t_C$, the temperature of the valve body (curve C') will cross-over the saturation temperature level. From time $t_C$, to time $t_C$, the relay control logic circuit RCL of FIG. 3 will monitor such favorable circumstance and make sure that a minimal difference exists between curve (B) and curve (C'). This is the critical condition which allows as early as time $t_C$, to open the stop valve SV, after having closed the drain valve DV. (In addition, as earlier stated, the control logic circuit RCL of FIG. 1 takes into consideration the temperature of the gland seal, or rather the steam temperature as it is safe to admit steam to the gland seal.) The minimum difference accepted in the example is 30° F., while the invention provides for a margin of difference between the steam temperature and the pressure of saturation on the face of the upper and lower valves (lines 29 and 33) which is 60° F., typically (line 23). Moreover, control is conditioned to a minimum temperature of steam of 350° F. for the steam to be admitted to the seal gland, of 420° F. for the body temperature of the stop valves, of 600° F. for the steam in front of the stop valves, as illustrated in FIG. 3 which relates to the relay control logic circuit RCL.

To summarize by reference to FIG. 3, the throttle pressure of line 1 is supplied as input to function generator FG thereby providing on line 2 the temperature of saturation of the steam. A summer 4 adds to the signal of line 2 a signal derived on line 3 and representing 30° F., thereby outputting on line 5 out of the summer 9 signal representing the temperature of saturation plus 30° F. A selective circuit 7 arbitrates between the signal of line 5 and a setpoint signal on line 6 representing 350° F., the larger of the two being outputted as a setpoint on line 8. The throttle temperature is supplied on line 9 and subtracted from the setpoint of line 8 at the input of a limiter 10, whereby on line 111 a logic signal is outputted defining whether the variable of line 9, e.g., the throttle temperature, remains smaller than the setpoint (the latter being at least 350° or the saturation pressure plus 30° F., whichever is larger). When the favorable condition has been reached, the signal of line 111 is passed by AND device 80 and the output, if all inputs are right, will be on line 11 a signal used to allow admitting steam to the gland seal. AND device 80 also receives the aforementioned signal of line 11' which is outputted by comparator 10' when it is ascertained between lines 1' and 2' that the steam pressure build-up has received 70 psig. AND device 80 further receives from line 79 the logic signal from logic circuit 78 which is set by line 77 and reset automatically after a time delay TD by line 76. Concurrent logic state at the input of AND device 80 results from a comparison of the throttle temperature $t_{TH}$ derived on line 91 and the steam turbine rotor temperature $t_{RT}$ derived on line 92. The differential circuit 93 provides after a lag by 94 a difference signal on lines 95 and 96. A high select circuit 97 establishes whether the rotor temperature $t_{RT}$ is close to the steam temperature $t_{TH}$ by less than 350° F., and low select circuit 99 establishes whether the steam temperature $T_{TH}$ is close to the rotor temperature $t_{RT}$ by less than 200° F. When either of these two conditions is fulfilled (on lines 75 and 74, respectively), this indicates that the available steam matches the rotor temperature. Therefore, gland seal stream can be applied to the steam turbine, since thermal stresses will not exist in the gland zone. As a result, the steam turbine life will be extended. Consequently, when OR device 82 insures that available steam matches rotor temperature (on line 75 or line 76), the logic signal of line 79 authorizes in line 11 the gland seal valve GDV to be opened, and steam to enter the gland seal zone. Otherwise, circuit 79 prevents it from being open. The same can be said of the signals of line 111 (for the stop valve body temperature $t_{BD}$ of line 9) and of line 11' (for the minimum steam pressure of 70 psig being available). Therefore, the gland seal steam cannot be applied until the available steam has the quality defined by lines 111 and 11' besides the aforementioned relationship between steam temperature and rotor temperature.

The signal of line 2 is also inputted by line 12 into another summer 14 together with a signal on line 13 representing 30° F. Selective circuit 17 arbitrates between the signal outputted on line 15 by summer 4 and a signal on line 16 representing 420 F. On line 18 a level is thus established which is compared with a signal representing the stop valve body temperature derived from line 19. The logic of the signal of line 21 at the output indicates whether the stop valve body temperature remains smaller than the value of line 18 (the latter being the larger of 420° F. and the pressure of saturation plus 30° F.). When the valve body is cold, the drain valve will be open, even though the bypass valve BPV is closed.

The signal of line 2 is further inputted by line 22 into a summer 24 together with a signal from line 23 representing 60° F., whereby on line 25 a signal is outputted representing the pressure of saturation plus 60° F. Again, a selective circuit 27 arbitrates the signal of line 25 and a signal on line 26 representing 600° F. The value so derived is compared by comparator 30 to a signal representing on line 29 the temperature of steam at the inlet of the upper stop valve UV. The setpoint from selective circuit 27 is also derived on line 32 and compared by a comparator 34 to a signal derived on line 33 representing the temperature of steam of the inlet of the lower stop valve LV. Consequently, at the output of comparator 30 the logic signal of line 31 indicates whether the steam temperature is lower than the value of line 28, whereas at the output of comparator 34, the logic signal of the line 35 indicated whether the steam temperature is lower than the value of line 33.

It appears that, in each instance, with line 11 for the gland seal, with line 21 for the upper valve body temperature, with line 31 for the upper stop valve inlet temperature, with line 35 for the lower stop valve inlet temperature, the actual temperatures (respective signals of lines 9, 19, 29 and 33) are all below the limit defined by the saturation temperature plus a predetermined margin (30° F., 30° F., 60° F. and 60° F., respectively). In addition to such concurrence of conditions expressed by AND device 81, before closing the drain valve DV in accordance with a permissive signal on line 84, the turbine must be latched, as indicated by line 102, before closing the drain valve DV.

Figure 5:
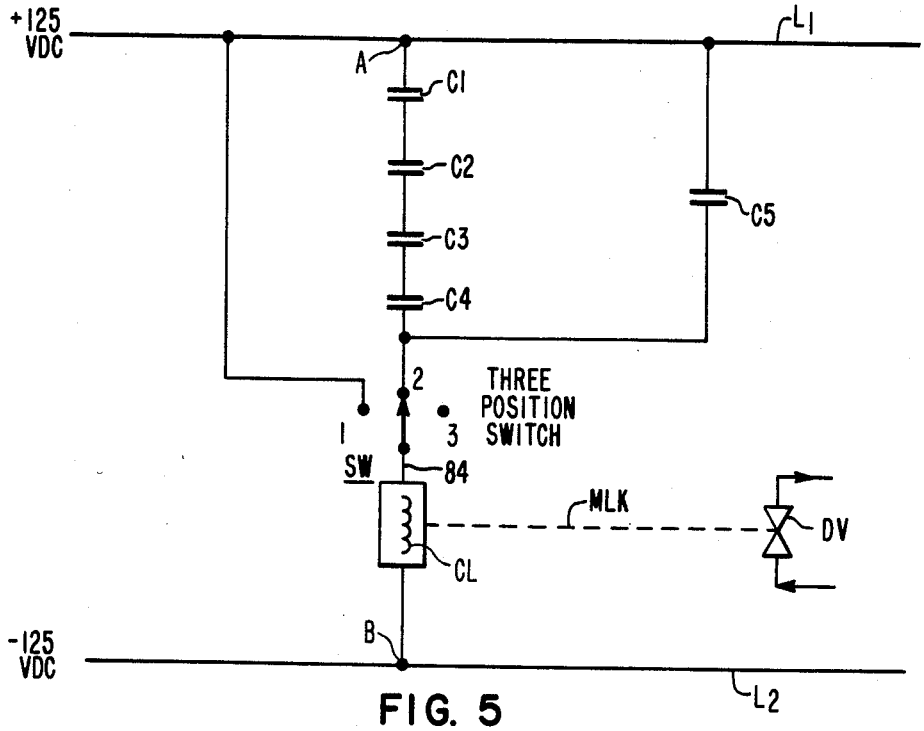
FIG. 5 is the valve relay circuit including contact circuitry translating into command the permissive states of FIG. 3.

FIG. 5 is a representation of the circuitry of the relay controlling valve DV.

A coil CL initially deenergized at start-up from line 101 (FIG. 1) is in series with contacts C1–C4 between points A and B of lines L1 and L2 which, typically, are at +125 volts and −125 volts, respectively. A three-position switch SW allows the operator to choose energization in position #1, automatic energization in position #2 and no energization in position #3. Assuming position 2 as shown, contacts C1–C4 are in parallel with contacts C5 which close momentarily during latch operation. Contacts C1 are closed when the logic signal for valve body temperature $t_{BD}$ is high. Contacts C2 are closed when the logic signal for the temperature of the lower stop valve (LV) is high. Contacts C3 are closed when the logic signal for the temperature of the higher stop valve (UV) is high. Contacts C4 are closed when the logic signal for the steam turbine generator power breaker being closed is high.

Closing of contacts C4 results from a command signal by line 102 to circuit RCL from control system 83 (FIG. 1). When the entire line of contacts C1–C4 is closed, energization of coil CL by the current of line 84 will cause the mechanical link MLK to actuate valve DV and close the drain line. Operation of the steam turbine under steam flow and control of the generated kilowatt output can follow.

Figure 6:
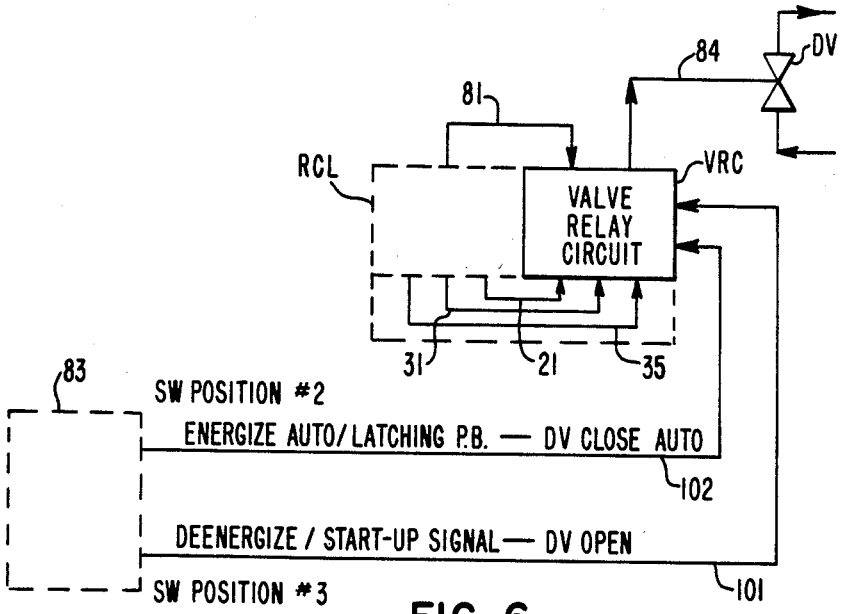

FIG. 6 shows the valve relay circuit of FIG. 5 inserted in the relay control logic circuit RCL, under control by lines 101 and 102 from the control system 83, conditioned by lines 81, 21, 31 and 35 from the logic of the circuit of FIG. 3, and controlling by line 84 the drain valve DV.

Summarizing the steam turbine start-up under initial derivation of steam during steam build-up from the heat recovery steam generator, the following sequence of operations is in order:

Initially, the admission to the steam turbine is closed. The drain valves are open, steam and piping are cold. The plant is ready for start-up. Steam pressure is nil.

Then, the combustion turbine associated with the heat recovery steam generator has been started and steam begins to build up.

The initial steam is vented and steam begins to flow into the header which provides access to the inlet of steam toward the closed valves (stop valves and governor valves) of the steam turbine. At this time admission of steam to the steam turbine is closed while the drain valves are open. Air is being pushed out of the header, thereby to quickly expose the piping and the stop valves (UV and LV) to the flow of warm steam. Besides, before admitting steam into the turbine, the condenser has to be put under vacuum, which can occur only after the gland seal has been sealed. The latter step is taken by opening the gland seal valve to admit pressurizing steam to the seal.

The gland seal valve (GDV) will open when the following criteria are met: the available steam matches the rotor temperature, the steam has reached minimum pressure and temperature.

Thereafter, the main condenser vacuum pumps are started to begin to extract the air from the condenser. Condenser pressure begins to reduce as air is being removed.

Once the condenser pressure is by a set value below atmospheric pressure, the control system will enable the bypass valve BPV to open and modulate the flow of steam to the condenser.

Steam is still flowing through the drain lines DL1, DL2, thereby heating the piping and the nearby valves.

The drain valve (DV) will close when the following conditions are met: minimal body temperature $t_{BD}$ and steam temperature criteria have been reached.

At this point, the steam turbine can be latched. This step will cause the drain valve DV to close and allow the stop valve SV to open. Normal start-up of the steam turbine can begin.

The above-stated procedure will minimize the time required to heat adequately the steam turbine stop valves and piping, and an optimum stop valve body temperature will have been set prior to start-up. Moreover, gland steam is not applied until it is safe so as not to create thermal stresses in the gland zones of the turbine. Also, boiler steam flow is achieved without dumping to atmosphere under "no vacuum" conditions (the latter prohibiting operation of the bypass valves, or other very high steam flow paths going to the condenser). Finally, boiler drum swell is prevented, which could occur when initial flow is established through the turbine bypass valve. A gradual, stepped increase in the boiler outlet flow is achieved, rather than a single large step.

What is claimed is:

1. In a system including a heat recovery steam generator and a steam turbine coupled to an electrical generator to be latched when loading the steam turbine, admission valve means for steam generated by said steam generator to said steam turbine, a condenser associated with said steam turbine, the combination of:

drain line means for fluidly connecting said steam generator to said condenser from a location close to said admission valve means;

drain valve means in said drain line means having a closed position blocking passage of steam to the condenser while said admission valve means are closed and an open position allowing passage of steam from said location to the condenser prior to said admission valve means being open;

valve control means responsive to a start-up condition of said heat recovery steam generator for controlling said drain valve means to adopt said open position, and responsive to a latched condition of said electrical generator for controlling said drain valve means to adopt said closed position; and logic control means being associated with said valve control means and responsive to an indication that the steam from said steam generator exceeds minimal pressure and temperature conditions, for establishing a preliminary condition prior to said latched condition.

2. The system of claim 1 with said indication being derived from a comparison with the temperature of said admission valve means in the closed position.

3. The system of claim 2 with said comparative indication being derived from an indication of the saturation temperature of said steam.

4. The system of claim 1 with said steam turbine having a gland seal and gland seal valve means for admitting sealing steam from said heat recovery steam generator to said gland seal; said gland seal valve means being opened following said start-up condition when the following three conditions are satisfied:

(a) the temperature of steam and the temperature of the steam turbine rotor are within a minimum range to one another;

(b) the steam from said heat recovery steam generator has a predetermined minimum pressure below said minimal pressure condition;

(c) the admission valve means temperature has reached a minimal level below said minimal temperature condition.

* * * * *